US006464131B1

(12) United States Patent
Blazevich

(10) Patent No.: US 6,464,131 B1
(45) Date of Patent: Oct. 15, 2002

(54) PACKING BOX DESIGN

(75) Inventor: John Z. Blazevich, Los Angeles, CA (US)

(73) Assignee: Contessa Food Products, Inc., San Pedro, CA (US)

( * ) Notice: Subject to any disclaimer, the term of this patent is extended or adjusted under 35 U.S.C. 154(b) by 0 days.

(21) Appl. No.: 09/844,289

(22) Filed: Apr. 26, 2001

(51) Int. Cl.[7] ..... B65D 5/22
(52) U.S. Cl. ..... 229/112; 229/164; 229/178
(58) Field of Search ..... 229/112, 164, 229/178

(56) References Cited

U.S. PATENT DOCUMENTS

| | | | | | |
|---|---|---|---|---|---|
| 2,105,057 | A | * | 1/1938 | Sharpe | 229/164 |
| 2,160,183 | A | | 5/1939 | Weltmer | |
| 2,181,483 | A | | 11/1939 | Greve | |
| 2,588,455 | A | * | 3/1952 | Adams | 229/164 |
| 2,657,849 | A | | 11/1953 | Paul et al. | |
| 2,749,016 | A | | 6/1956 | Cote | |
| 2,965,279 | A | | 12/1960 | Campbell | |
| 2,979,250 | A | | 4/1961 | Hobbs | |
| 3,014,635 | A | * | 12/1961 | Mairs et al. | 229/164 |
| 3,091,381 | A | | 5/1963 | Conescu | |
| 3,361,329 | A | | 1/1968 | Fox | |
| 3,568,877 | A | | 3/1971 | Mastrud, Jr. | |
| 4,105,152 | A | | 8/1978 | Elward | |
| 4,127,228 | A | | 11/1978 | Hall | |
| 4,437,713 | A | | 3/1984 | Roach | 312/259 |
| 4,471,901 | A | | 9/1984 | Stahlecker | |
| 4,974,773 | A | | 12/1990 | Alexander et al. | 229/164 |
| 5,156,270 | A | | 10/1992 | Kachel et al. | 206/451 |
| 5,277,360 | A | * | 1/1994 | DeMott | 229/164 |
| 5,330,094 | A | | 7/1994 | Mertz | 229/167 |
| 5,535,942 | A | | 7/1996 | Vilona | 229/199 |
| 5,718,337 | A | | 2/1998 | Carr et al. | 206/554 |
| 5,860,590 | A | | 1/1999 | Blomfield et al. | 229/165 |

FOREIGN PATENT DOCUMENTS

| | | | | |
|---|---|---|---|---|
| DE | 4003104 A1 | * | 8/1991 | 229/164 |
| FR | 2653410 A1 | * | 4/1991 | 229/112 |

* cited by examiner

*Primary Examiner*—Gary E. Elkins
(74) *Attorney, Agent, or Firm*—Christie, Parker & Hale, LLP

(57) ABSTRACT

The present invention presents an innovative packing box for food-stuffs which may serve as both a shipping carton and as a display box. The carton is constructed from a single, continuous blank of corrugated cardboard or other suitable material. The carton includes inwardly sloping side walls with support ledges to allow for easy stacking of the cartons. The side walls are of folded over design which provides the walls with a double thickness of material for added durability. The carton further includes a front window which provides convenient access to the food-stuffs stored within.

17 Claims, 3 Drawing Sheets

PACKING BOX DESIGN

BACKGROUND OF THE INVENTION

The present invention relates generally to cartons, and more particularly, to a stackable carton for storing, shipping, and dispensing loose-packed food-stuffs which are typically sealed in plastic bags.

Numerous foldable cartons are known in the art. One such typical carton is U.S. Pat. No. 5,718,337 entitled "Carton for Plastic Bags," issued to Carr et al. This carton may be folded from a single piece of cardboard where the needed flaps and fold lines are pre-pressed into the cardboard. The carton is of a rectangular design and features windows in both short sides of the carton. The carton further includes stacking ledges along a portion of the upper edges of the long sides of the carton. The stacking ledges are intended to allow multiple cartons to be stacked vertically one on top of the other. Although, generally suitable for use as a shipping carton, this design has certain drawbacks. Namely, the walls of the carton are straight. Thus, a series of cartons may be stacked vertically only so long as the walls of each carton remain straight and thereby provide support for the cartons stacked on top of them. Unfortunately, the walls of cardboard cartons rarely remain straight. The walls have a tendency to bow outwardly with use. Typically, this happens with the ordinary handling associated with the shipment of bulk goods. In addition, high humidity, a condition often found in the holds of ships and in railway flat cars and the beds of enclosed trucks will tend to warp or otherwise cause the walls of the carton to deviate from their original straight construction. A further drawback of this carton is that the stacking ledges are relatively small and provide only minimal support for each succeeding carton in a vertical stack.

Another typical carton is shown in U.S. Pat. No. 2,979,250 entitled "Cartons," issued to Hobbs. Similar to the carton discussed above, this carton may be made by folding a single piece of cardboard along fold lines pre-pressed into the cardboard. This carton over comes some of the disadvantages mentioned above in that the carton provides a recessed bottom designed to nestably receive the upper few inches of each similar carton stacked above it. Although probably effective as a shipping container, this carton also has certain drawbacks. One drawback of this carton, and of nested cartons in general, is that when the cartons are heavily loaded, the weight of each carton makes it difficult to remove the top carton in a vertical stack from its nesting position, since the carton must be lifted upwardly for several inches before it becomes free of the carton in which it rests. Another drawback of this carton is that it does not make the most efficient use of the available space in that some of the carton's storage capacity is taken up by the recessed bottom which provides the carton with its nesting ability. Thus, there is room for improvement in the art of carton design.

SUMMARY OF THE INVENTION

It is an object of the invention to supply a carton which may be produced at minium cost, that is reusable, and that possesses sufficient strength to be stackable, and to withstand the ususal handling to which food-stuffs are subjected during shipping. It is an object of the invention to provide a carton with sufficient strength to be stackable without the need for a cover or top. It is a further object of the invention to provide a carton that is not only suitable as a shipping container, but is also suitable as a display container in large warehouse type stores.

The present invention is a carton for shipping food-stuffs of the type typically sealed in plastic bags. The carton comprises a bottom wall, opposing front and back walls extending upwardly from the bottom wall, and opposing first and second side walls extending upwardly and sloping inwardly from the bottom wall and bridging the opposing front and back walls. The front wall includes a profiled upper edge forming a window adapted to accommodate a typical food-stuff package (about 4 inches by 6 inches) and to thereby allow the retrieval of the food-stuffs via the window. The front wall further includes a reinforcing flap.

The carton of the present invention is preferably stamped from a single piece of sturdy foldable material, such as heavy gauge corrugated cardboard. Each portion of the carton which is to be folded is preferably provided with a crease or fold line during the stamping process to ensure easy assembly. The folded portions of the carton are preferably held in place by means of locking tabs and slots. The carton may be assembled without additional materials, such as tape, or adhesives. The exterior of the walls of the carton may be marked with indicia to enhance the cartons attractiveness as a display. These and other features of the invention will become more apparent from the following detailed description of the invention, when taken in conjunction with the accompanying exemplary drawings.

DETAILED DESCRIPTION OF THE INVENTION

Figure 1:
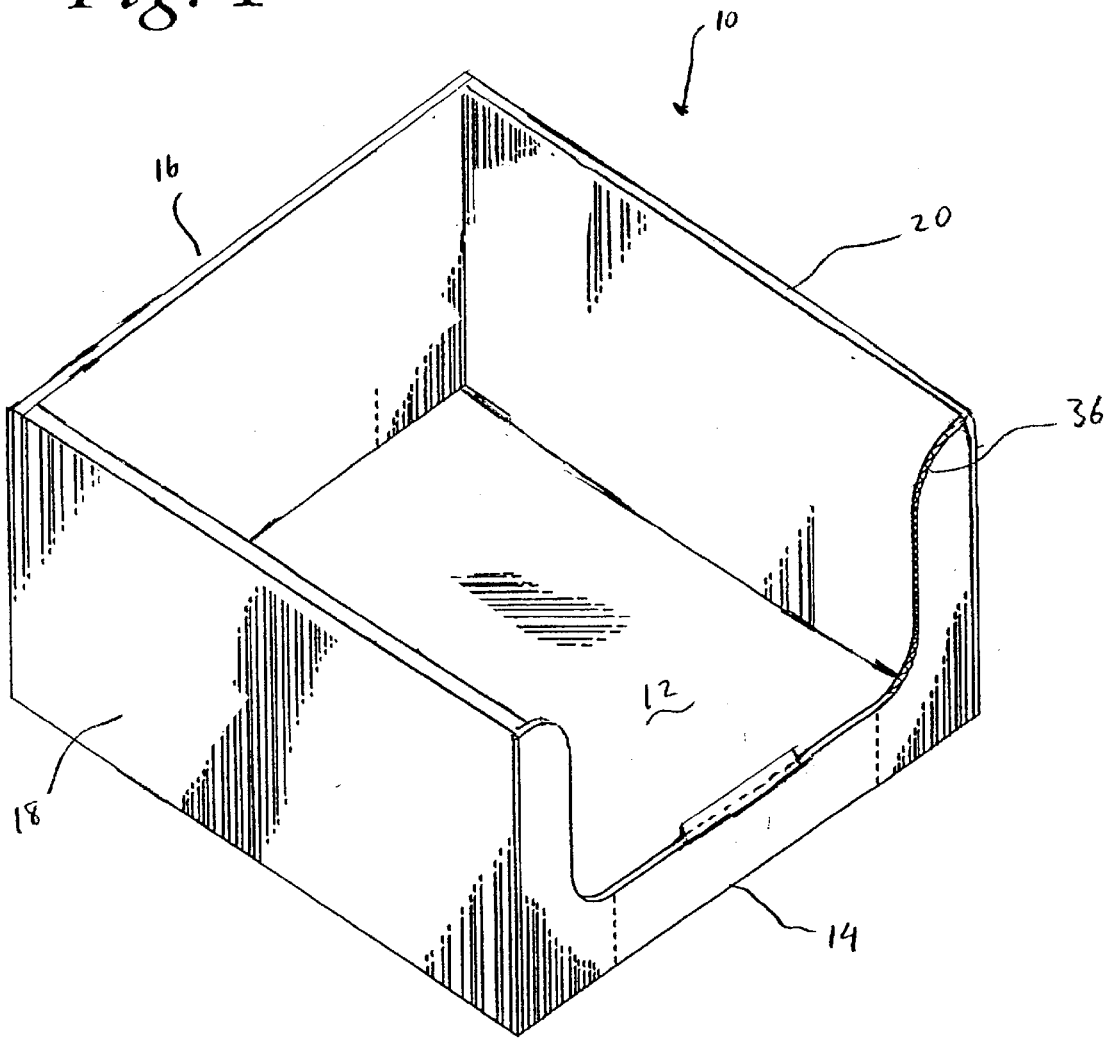
FIG. 1 is an isometric view of a corrugated carton embodying the present invention.
Figure 2:
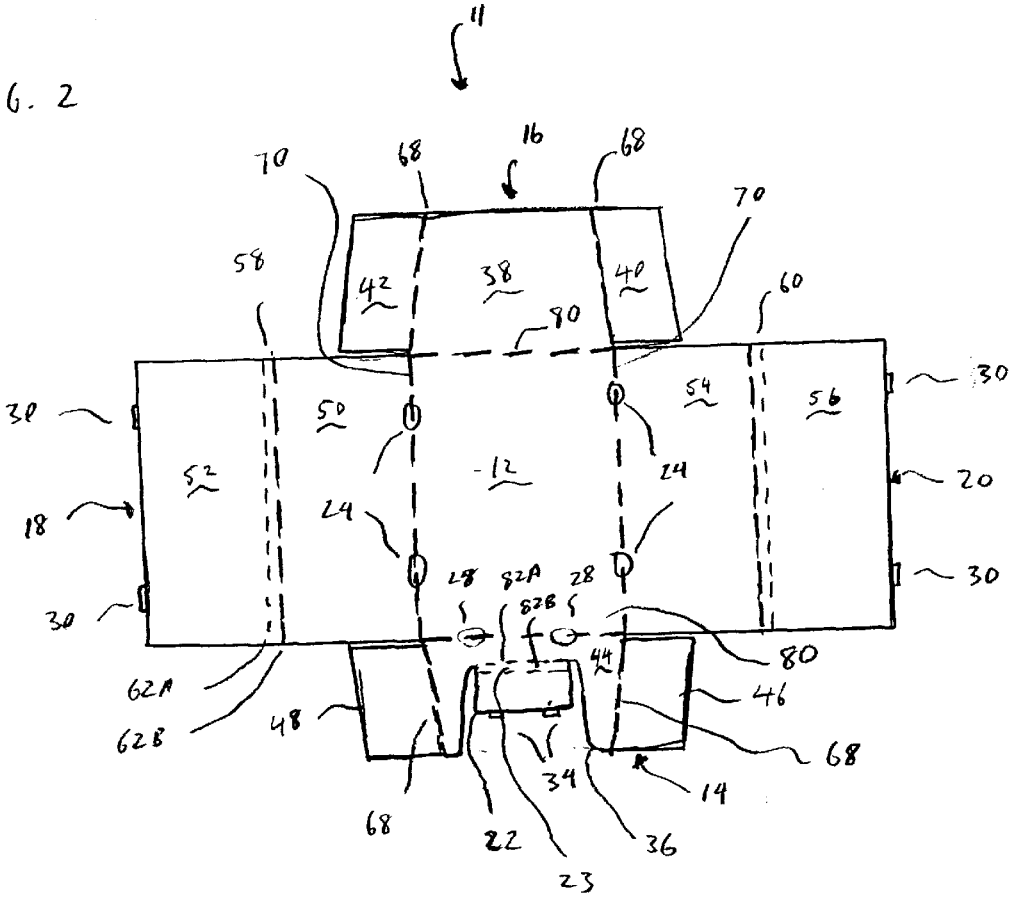
FIG. 2 is a plan view of an inside surface of a blank for forming the corrugated carton in FIG. 1.

Turning now to the drawings, FIGS. 1 and 2, depict a corrugated carton 10 for loose-packed food-stuffs in accordance with the present invention. Although the illustrated carton 10 is composed of a single, unitary, corrugated cardboard blank 11, the carton may alternatively be made from other suitable materials such as paperboard, fiberboard, plastic, and laminated and non-laminated multiple layer materials.

With continued reference to FIGS. 1 and 2, the carton 10 includes a bottom wall 12, opposing front and back walls 14 and 16, and opposing first and second side walls 18 and 20. The opposing front and back walls 14 and 16 extend upwardly from, and are generally perpendicular to, the bottom wall 12. The back wall includes a center panel 38 and right and left side flaps 40 and 42. The front wall includes a center panel 44 which includes a profiled edge 36 forming an access window sized to allow for the easy retrieval of food-stuffs. The front wall also includes right and left side flaps 46 and 48, and a front reinforcing flap 22. The front and back walls are hingedly connected the bottom wall along crease lines 80. The right and left side flaps of the front and rear walls are hingedly connected along crease lines 68 which are identified as dashed lines in the figures. The front reinforcing flap is hingedly connected along a pair of crease lines 82A and 82B to the front center panel. The space between the crease lines defines a reinforced sill area 23 when the reinforcing flap is folded into position. The reinforcing flap includes a pair of tabs 34, which are insertable into slots 28. The slots are formed at the junction between the front wall and the bottom wall.

The first and second side walls 18 and 20 extend upwardly from, and slope inwardly from, the bottom wall 12. Thus, unlike the front and back walls, the first and second side walls are not generally perpendicular to the bottom wall. Rather, the first and second side walls slope inwardly from the bottom wall. Preferably, the first and second walls will from an angle with the bottom wall in the range of about 70 to about 85 degrees. The first side wall further includes an inner panel 52 and an outer panel 50. Between the inner and outer panels is a stacking ledge 58. It should be noted that this stacking ledge extends along the full length of the wall. The outer panel includes a pair of tabs 30 which are insertable into slots 24. The slots are formed at the junction between the inner panel and bottom wall. The inner and outer panels are hingedly connected to the stacking ledge along a pair of crease lines 62, as shown. The inner panel is hingedly connected to the bottom wall along a crease line 70, as shown.

The structure of the second side wall 20 is identical to the structure of the first side wall and therefore a detailed description is not required. It is sufficient to say that the second side wall includes an inner panel 56, a stacking ledge 60, an outer panel 54, tabs 30 and slots 24.

Figure 3:
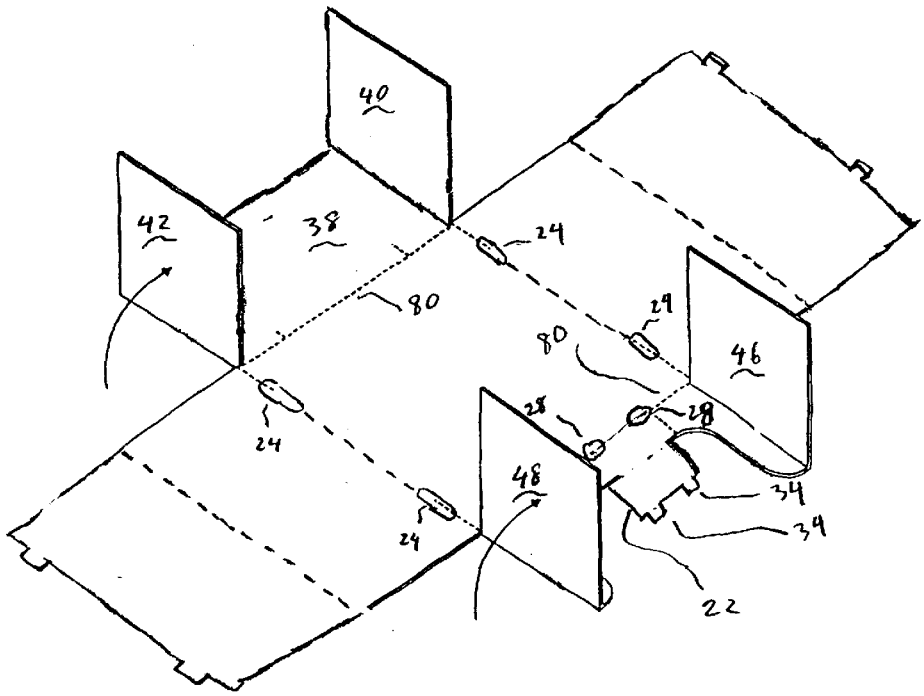
FIGS. 3, 4, and 5 are isometric views showing the sequence of folding the blank to produce the corrugated carton in FIG. 1.
Figure 4:
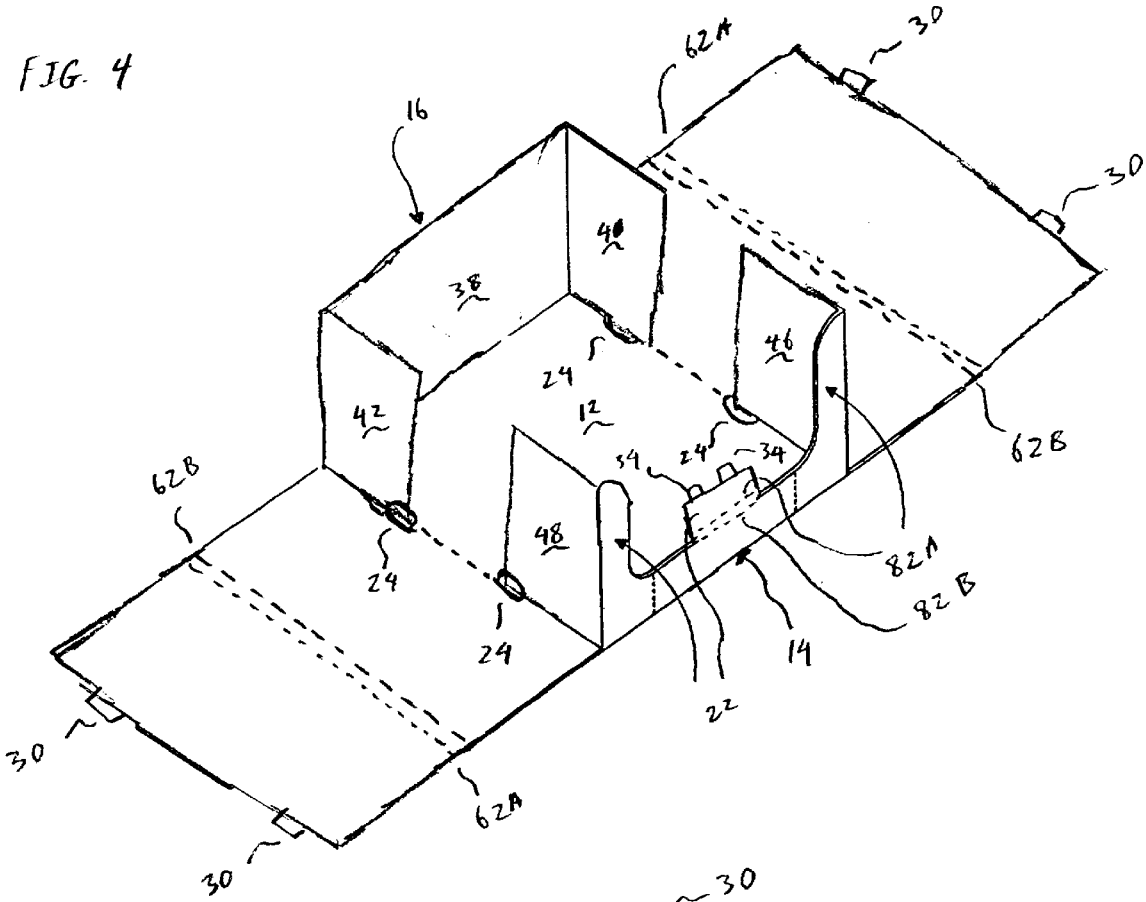
Figure 5:
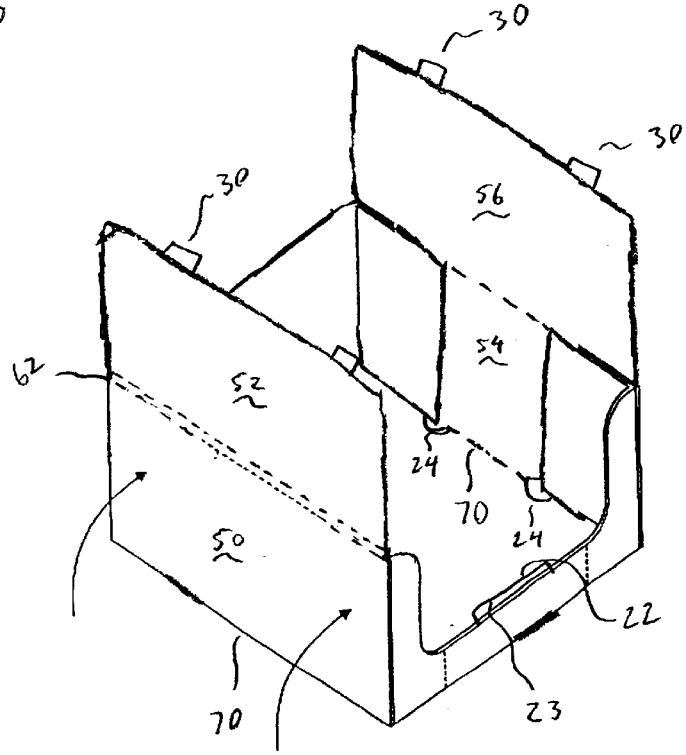

The blank 11 of FIG. 2 is folded to form the carton of FIG. 1, as is illustrated in FIGS. 3–5. To achieve the blank configuration of FIG. 4 from the flat blank of FIG. 3, the side flaps of the front wall 46 and 48, are folded upwardly, approximately 90 degrees, with respect to the front panel 44, along the crease lines 68. Likewise the side flaps 40 and 42 are folded upwardly, approximately 90 degrees, with respect to the back panel 38, along the crease lines 68.

To achieve the blank configuration of FIG. 4, from the blank configuration of FIG. 3 the front and back walls 14 and 16 are folded upwardly approximately 90 degrees relative to the bottom wall 12, along the respective crease lines 80.

To achieve the blank configuration of in FIG. 5 from the blank configuration of FIG. 4, the outer side panels 50 and 54 are folded upwardly, along the crease lines 70 so that the panels slope inwardly with respect to the bottom wall 12. It has been found that folding the outer panels upwardly within a range of about 95 to about 120 degrees, provides adequate inward spacing such that the stacking ledges 58 and 60 may support the containers 10 stacked above them.

The blank configuration of FIG. 5 is folded into the completed carton shown in FIG. 1, by folding over the inner side panels 52 and 56. In particular, the inner side panels are folded inwardly, approximately 180 degrees, with respect to the outer side panels 50 and 54, along the parallel crease lines 62A and 62B, defining the stacking ledges 58 and 60. The inner side panels are retained in this position by folding the locking tabs 30 into the slots 24. To complete the container, the front reinforcing panel 22 is folded about 180 degrees downwardly with respect to the front panel 44, about the parallel crease lines 82A and 82B. The narrow panel defined by the crease lines 82A and 82B is a front reinforcing sill 23. The front reinforcing panel is secured in this position by the locking tabs 34 which are inserted into the slots 28. The exterior surfaces of the completed container may be covered with decorative indica to enhance the container's usefulness as a product display.

The present invention presents an innovative packing box which may serve as both a shipping carton and as a display box. The carton is constructed from a single, continuous blank of corrugated cardboard, or other suitable material. The carton includes inwardly sloping side walls with support ledges to allow for easy stacking of the cartons. The side walls are of folded over design which provides the walls with a double thickness of material for added durability. The carton further includes a front window which provides convenient access to the food-stuffs stored within. The front opening window is particularly advantageous when multiple cartons are stacked one on top of the other. While only the presently preferred embodiments have been described in detail, as will be apparent to those skilled in the art, modifications and improvements may be made to the system and method disclosed herein without departing from the scope of the invention. Accordingly, it is not intended that the invention be limited except by the appended claims.

What is claimed is:

1. A shipping carton, comprising:

a bottom wall;

opposing front and back walls extending upwardly from the bottom wall;

opposing first and second side walls extending upwardly and inwardly from the bottom wall, and bridging the opposing front and back walls, wherein each of the opposing first and second side walls include inner and outer panels;

two flaps extending from each of the opposing front and back walls, one flap from the front wall and one flap from the back wall located between the inner and outer panels of each of the opposing first and second side walls; and the front wall having a profiled opening defining a front window, wherein the front window provides access to the interior of the shipping carton.

2. The shipping carton of claim 1, wherein the inner panel is folded over the outer panel to define a stacking ledge and to provide a double thickness side wall and each outer panel has an exterior surface extending upwardly and inwardly from the bottom wall.

3. The shipping carton of claim 1, wherein the front wall includes a front reinforcing panel, wherein the front reinforcing panel is folded over the front wall to provide a reinforced sill area.

4. The shipping carton of claim 1, wherein the opposing side walls are folded inwardly within the range of about 95 to 120 degrees with respect to the bottom wall.

5. The shipping carton of claim 1, wherein the carton is made from a single, unitary, sheet of material.

6. The shipping carton of claim 5, wherein the sheet of material is corrugated cardboard.

7. The shipping carton of claim 1, further comprising packages of food-stuff between the front and back walls and between the first and second side walls, wherein the front window is sized to accommodate the easy removal of the packages of food-stuff.

8. The shipping carton of claim 1, wherein the exterior of the walls of the carton are marked with indicia to enhance the carton's attractiveness for use as a display.

9. A shipping carton, comprising:

a bottom wall;

opposing front and back walls extending upwardly from the bottom wall;

opposing first and second side walls bridging the opposing front and back walls, each of the first and second side walls having an exterior surface extending upwardly and inwardly from the bottom wall;

wherein each of the opposing first and second side walls include inner and outer panels, the inner panel and the outer panel for each of the opposing first and second side panels connected along a top edge of the respective side panel to form a stacking ledge;

the front wall having a profiled opening defining a front window, wherein the front window provides access to the interior of the shipping carton.

10. The shipping carton of claim 9, wherein the bottom wall is planar and forms a lowermost portion of the shipping carton.

11. The shipping carton of claim 9, wherein the front wall extends perpendicular from the bottom wall.

12. The shipping carton of claim 9, wherein the front wall includes a front reinforcing panel, wherein the front reinforcing panel is folded over the front wall to provide a reinforced sill area.

13. The shipping carton of claim 9, wherein the opposing side walls are folded inwardly within the range of about 95 to 120 degrees with respect to the bottom wall.

14. The shipping carton of claim 9, wherein the carton is made from a single, unitary, sheet of material.

15. The shipping carton of claim 9, wherein the sheet of material is corrugated cardboard.

16. The shipping carton of claim 9, further comprising flaps extending from each of the opposing front and back walls, one flap from the front wall and one flap from the back wall located between the inner and outer panels of each of the opposing first and second side walls.

17. The shipping carton of claim 9, further comprising packages of food-stuff between the front and back walls and between the first and second side walls wherein the front window is sized to accommodate the easy removal of the packages of food-stuff.

* * * * *